US008536472B2

(12) United States Patent
Wu et al.

(10) Patent No.: US 8,536,472 B2
(45) Date of Patent: Sep. 17, 2013

(54) ROTARY SWITCH MECHANISM

(75) Inventors: Chun-Che Wu, Taipei (TW); Chun-Nan Su, Taipei (TW)

(73) Assignee: Primax Electronics Ltd., Taipei (TW)

( * ) Notice: Subject to any disclaimer, the term of this patent is extended or adjusted under 35 U.S.C. 154(b) by 393 days.

(21) Appl. No.: 13/076,760

(22) Filed: Mar. 31, 2011

(65) Prior Publication Data

US 2012/0186951 A1 Jul. 26, 2012

(30) Foreign Application Priority Data

Jan. 21, 2011 (TW) ..... 100102260 A

(51) Int. Cl.
*H01H 9/00* (2006.01)

(52) U.S. Cl.
USPC ..... 200/4; 200/14; 345/184; 362/23.16; 362/23.22; 250/227.22

(58) Field of Classification Search
USPC ..... 200/4, 5 R, 6 A, 17 R, 13, 14, 18, 200/11 C, 11 DA, 273, 292, 336, 410, 412, 200/570, 50.34, 50.36, 51.16, 50.17; 324/173, 324/174, 207.2, 207.21, 207.25; 345/156–160, 345/169, 184; 362/23, 26, 27, 29, 613; 341/33, 341/35; 250/227.22
See application file for complete search history.

(56) References Cited

U.S. PATENT DOCUMENTS

| | | | | |
|---|---|---|---|---|
| 8,294,049 | B2 * | 10/2012 | Tsuduki | 200/5 R |
| 2006/0157327 | A1 * | 7/2006 | Chou et al. | 200/14 |
| 2007/0272524 | A1 * | 11/2007 | Girke et al. | 200/11 DA |
| 2012/0055763 | A1 * | 3/2012 | Chou | 200/4 |

* cited by examiner

*Primary Examiner* — Renee Luebke
*Assistant Examiner* — Harshad Patel
(74) *Attorney, Agent, or Firm* — Kirton McConkie; Evan R. Witt

(57) ABSTRACT

A rotary switch mechanism includes a first rotatable member, a second rotatable member, a push button and a triggered switch. By rotating the first rotatable member, a first rotation command is executed. By rotating the second rotatable member, a second rotation command is executed. By moving a user's finger on the push button, a motion command is executed. By pressing down the push button to trigger the push switch, a pushing command is executed. In such way, the rotary switch mechanism may be used to input plural commands.

10 Claims, 8 Drawing Sheets

ROTARY SWITCH MECHANISM

FIELD OF THE INVENTION

The present invention relates to a rotary switch mechanism, and more particularly to a rotary switch mechanism with a push button function.

BACKGROUND OF THE INVENTION

Generally, a rotary switch mechanism is a mechanism that is rotated in either a clockwise direction or an anti-clockwise direction. For example, the rotary switch mechanism is usually installed on an acoustical device for adjusting sound volume or changing broadcast channels.

With the increasing development of science and technology, the applications of the rotary switch mechanism are gradually expanded. Generally, as shown in FIG. 1, the rotary switch mechanism 10 is installed on a keyboard device 1 of a computer system in order to enhance the function of the keyboard device 1. By operating the rotary switch mechanism 10, a sound volume adjustment command of a video player program, a text file proportional scale command or an image file proportional scale command in the computer system may be executed.

Hereinafter, the internal structures and the operating principles of a conventional rotary switch mechanism will be illustrated with reference to FIGS. 2 and 3. FIG. 2 is a schematic exploded view illustrating a conventional rotary switch mechanism. FIG. 3 is a schematic perspective view illustrating the outward appearance of the conventional rotary switch mechanism. As shown in FIGS. 2 and 3, the conventional rotary switch mechanism 2 comprises a circuit board 20, a rotatable member 21, a push button 22, a rotary switch 23, an elastic element 24, a first push switch 25, a second push switch 26, a third push switch 27, a fourth push switch 28 and a fifth push switch 29.

The circuit board 20 has a mounting aperture 201. The rotatable member 21 has plural projecting parts 211, which are arranged at the periphery of the rotatable member 21. The push button 22 comprises a central button part 221, a ring-shaped part 222 and a fixing part 223. The ring-shaped part 222 is connected with the central button part 221 and arranged around the central button part 221. The fixing part 223 is disposed on the ring-shaped part 222. After the fixing part 223 is engaged with the mounting aperture 201 of the circuit board 20, the push button 22 is fixed on the circuit board 20. The five push switches 25, 26, 27, 28 and 29, the rotary switch 23 and the elastic element 24 are all disposed on the circuit board 20. In addition, the five push switches 25, 26, 27, 28 and 29 are disposed under the push button 22. The rotary switch 23 is arranged beside the push button 22. In addition, the rotary switch 23 has a handle part 231.

Upon rotation of the rotatable member 21 of the rotary switch mechanism 2, the plural projecting parts 211 of the rotatable member 21 are synchronously rotated. As the projecting parts 211 are rotated, the projecting parts 211 interact with the handle part 231 of the rotary switch 23 so as to swing the handle part 231. As the handle part 231 is swung, a rotation signal is generated. In response to the rotation signal, a specified command (e.g. the sound volume adjustment command) is executed. Moreover, upon rotation of the rotatable member 21, the handle part 231 may be swung in either a clockwise direction or an anti-clockwise direction to generate two different rotation signals. According to the two rotation signals, a sound volume increasing command and a sound volume decreasing command are respectively executed. On the other hand, during the process of rotating the rotatable member 21, the elastic element 24 is contacted with plural notches (not shown) that are arranged at the inner periphery of the bottom side of the rotatable member 21 so as to result in an elastic force. Due to the elastic force, the rotation of the rotatable member 21 results in a multi-step rotating feel to the user.

By pressing the central button part 221 of the conventional rotary switch mechanism 2, the central button part 221 is moved downwardly to push against the first push switch 25 under the central button part 221. As a result, the first push switch 25 is triggered to generate a first triggering signal. In response to the first triggering signal, another specified command (e.g. a clicking and selecting command) is executed. By pressing the ring-shaped part 222 of the conventional rotary switch mechanism 2, the second push switch 26 under the ring-shaped part 222 is triggered to generate a second triggering signal. In response to the second triggering signal, another specified command (e.g. a text file proportional scale-up command) is executed. By pressing the ring-shaped part 222 of the conventional rotary switch mechanism 2, the third push switch 27 is triggered to generate a third triggering signal. In response to the third triggering signal, another specified command (e.g. a text file proportional scale-down command) is executed. Moreover, by triggering the fourth push switch 28 and the fifth push switch 29, different commands (e.g. an image file proportional scale-up command and an image file proportional scale-down command) are executed. The operations of the fourth push switch 28 and the fifth push switch 29 are similar to those of the second push switch 26 and the third push switch 27, and are not redundantly described herein.

From the above discussions, the conventional rotary switch mechanism 2 may be operated to execute at most four commands. That is, the sound volume adjustment command is executed by rotating the rotatable member 21, the clicking and selecting command is executed by pressing the central button part 221, the text file proportional scale command is executed by pressing the ring-shaped part 222, and the image file proportional scale command is executed by pressing the ring-shaped part 222. The conventional rotary switch mechanism 2, however, still has some drawbacks. For example, since the conventional rotary switch mechanism 2 can execute at most four commands, the conventional rotary switch mechanism 2 fails to meet the user's requirements. In addition, since the rotatable member 21 and the push button 22 of the conventional rotary switch mechanism 2 are in contact with each other, upon rotation of the rotatable member 21, the jointing regions between the rotatable member 21 and the push button 22 may rub against each other. Since a long-termed use may abrade the structure of the conventional rotary switch mechanism 2, the use life of the conventional rotary switch mechanism 2 is shortened. Moreover, since the five push switches 25, 26, 27, 28 and 29 of the conventional rotary switch mechanism 2 are disposed under the rotatable member 21, if the force exerted on the rotatable member 21 is unevenly distributed during the process of rotating the rotatable member 21, the rotatable member 21 is readily tilted. Since the ring-shaped part 222 of the push button 22 is also tilted, the possibility of erroneously touching the push switches 25, 26, 27, 28 and 29 will be increased. Under this circumstance, an erroneous operation problem possibly occurs.

SUMMARY OF THE INVENTION

The present invention provides rotary switch mechanism capable of executing more function commands.

The present invention also provides a rotary switch mechanism to reduce the possibility of the erroneous operation problem.

In accordance with an aspect of the present invention, there is provided a rotary switch mechanism. The rotary switch mechanism includes a main circuit board, a base, a first rotatable member, a first signal-generating module, a second rotatable member, a second signal-generating module and a push button. The base is disposed on the main circuit board. The first rotatable member is disposed on the base and rotatable with respect to the base. The first signal-generating module is mounted on the main circuit board. In response to rotation of the first rotatable member, the first signal-generating module generates a first rotation signal. The second rotatable member is disposed on the base, arranged around the first rotatable member, and rotatable with respect to the base. The second signal-generating module is mounted on the main circuit board. In response to rotation of the second rotatable member, the second signal-generating module generates a second rotation signal. The push button is disposed within the first rotatable member, and comprising a pushing surface. The push button includes an optical finger navigation module and a push switch. The optical finger navigation module is disposed within the push button and arranged under the pushing surface of the push button for detecting a motion of a user's finger on the pushing surface. In response to the motion of the user's finger, the optical finger navigation module generates a motion signal. The push switch is disposed under the optical finger navigation module. When the push button is pressed down, the push switch is triggered to generate a triggering signal.

In an embodiment, the first signal-generating module includes a magnetic ring and a reed sensor assembly. The magnetic ring is disposed on a lower portion of the first rotatable member, and synchronously rotated with the first rotatable member. The reed sensor assembly is mounted on the main circuit board and arranged in the vicinity of the magnetic ring for detecting rotation of the magnetic ring, thereby generating the first rotation signal.

In an embodiment, the magnetic ring includes plural N-pole regions, plural S-pole regions and plural spacer regions. One side of each spacer region is adjacent to an N-pole region, and the other side of each spacer region is adjacent to an S-pole region.

In an embodiment, the reed sensor assembly includes a first reed sensor and a second reed sensor. The first reed sensor is disposed under the N-pole region or the S-pole region to detect a magnetic field change between the N-pole region and the S-pole region. The second reed sensor is disposed under the spacer region to detect a magnetic field change between the N-pole region and the S-pole region.

In an embodiment, the second signal-generating module includes an idle wheel and an encoder. The idle wheel is disposed on the base, and includes a rotating shaft and plural idle wheel saw-toothed parts. The plural idle wheel saw-toothed parts are engaged with plural rotatable member saw-toothed parts of the second rotatable member, so that the idle wheel is synchronously rotated with the second rotatable member. The encoder is mounted on the main circuit board. The rotating shaft of the idle wheel is inserted into the encoder. In response to rotation of the idle wheel, the second rotation signal is generated by the encoder.

In an embodiment, the push button further includes a push button holder, an elastic element and a push button circuit board. The push button holder is disposed on the first rotatable member and movable upwardly and downwardly with respect to the first rotatable member. The push button holder includes a central sleeve and a central hole. The central sleeve is disposed under the push switch. The central hole is disposed in a center of the central sleeve. The elastic element is sheathed around the central sleeve and sustained against the first rotatable member for providing an elastic force. In response to the elastic force, the push button holder is movable upwardly. The push button circuit board is disposed on the push button holder. The optical finger navigation module is disposed on a first surface of the push button circuit board. The push switch is disposed on a second surface of the push button circuit board.

In an embodiment, the first rotatable member further includes a light guide structure, plural perforations and a triggering part. The light guide structure is disposed within the first rotatable member. A top portion of the light guide structure is exposed outside the first rotatable member and arranged around the pushing surface of the push button. After the push button holder is penetrated through the plural perforations, the push button holder is engaged with the light guide structure. The triggering part is arranged between the plural perforations, penetrated through the central hole and arranged in the vicinity of the push switch. When the push button is pressed down to push against the push switch, the triggering signal is generated by the push switch.

In an embodiment, the rotary switch mechanism further includes plural light emitting diodes, which are mounted on the main circuit board for emitting plural light beams. After the plural light beams are directed to the light guide structure, the light beams are guided by the light guide structure and projected onto a region between the push button and the first rotatable member.

In an embodiment, the light guide structure and the triggering part are integrally formed.

In an embodiment, the optical finger navigation module includes a light source, a reflective mirror, a focusing lens and a motion sensor. The light source is used for emitting a light beam to be projected on the pushing surface of the push button. The reflective mirror is used for reflecting the light beam. The focusing lens is used for focusing the light beam that is reflected by the user's finger. The motion sensor is used for receiving the light beam, and generating the motion signal according to the light beam.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
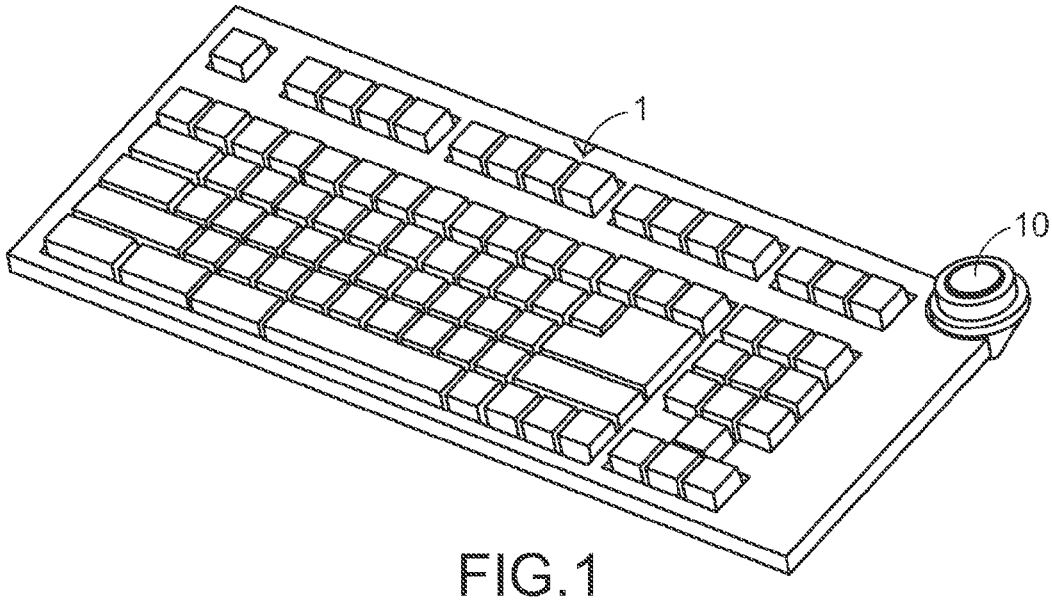
FIG.1 PRIOR ART
FIG. 1 is a schematic perspective view illustrating the outward appearance of a rotary switch mechanism installed on a keyboard device according to the prior art.
Figure 2:
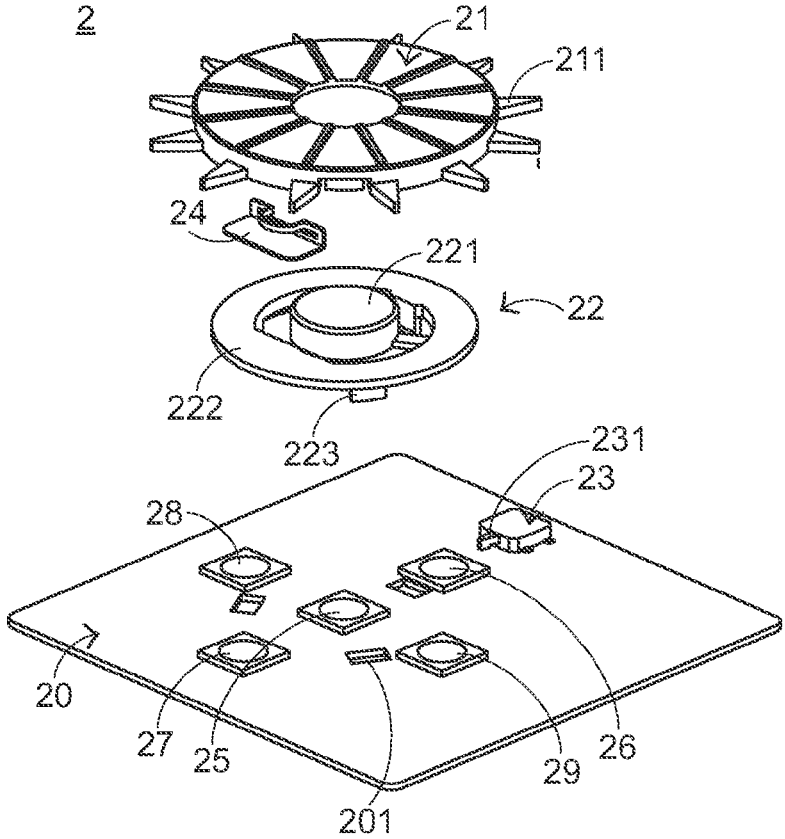
FIG.2 PRIOR ART
FIG. 2 is a schematic exploded view illustrating a conventional rotary switch mechanism.
Figure 3:
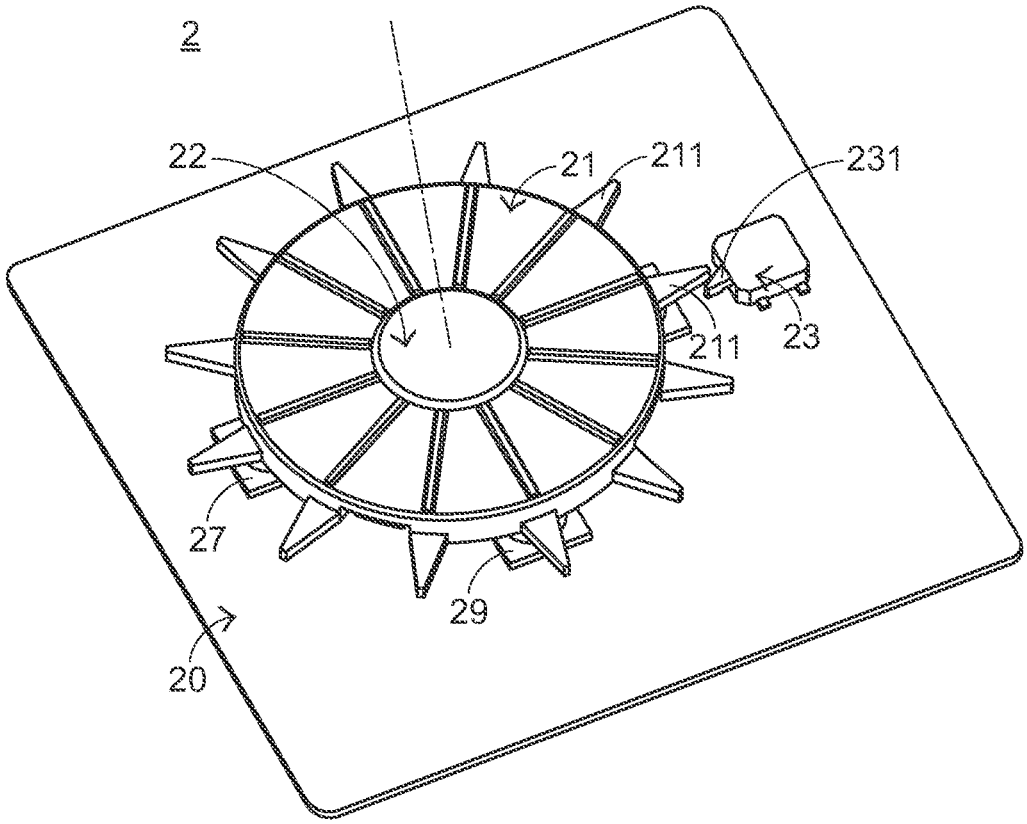
FIG.3 PRIOR ART
FIG. 3 is a schematic perspective view illustrating the outward appearance of the conventional rotary switch mechanism.
Figure 4:
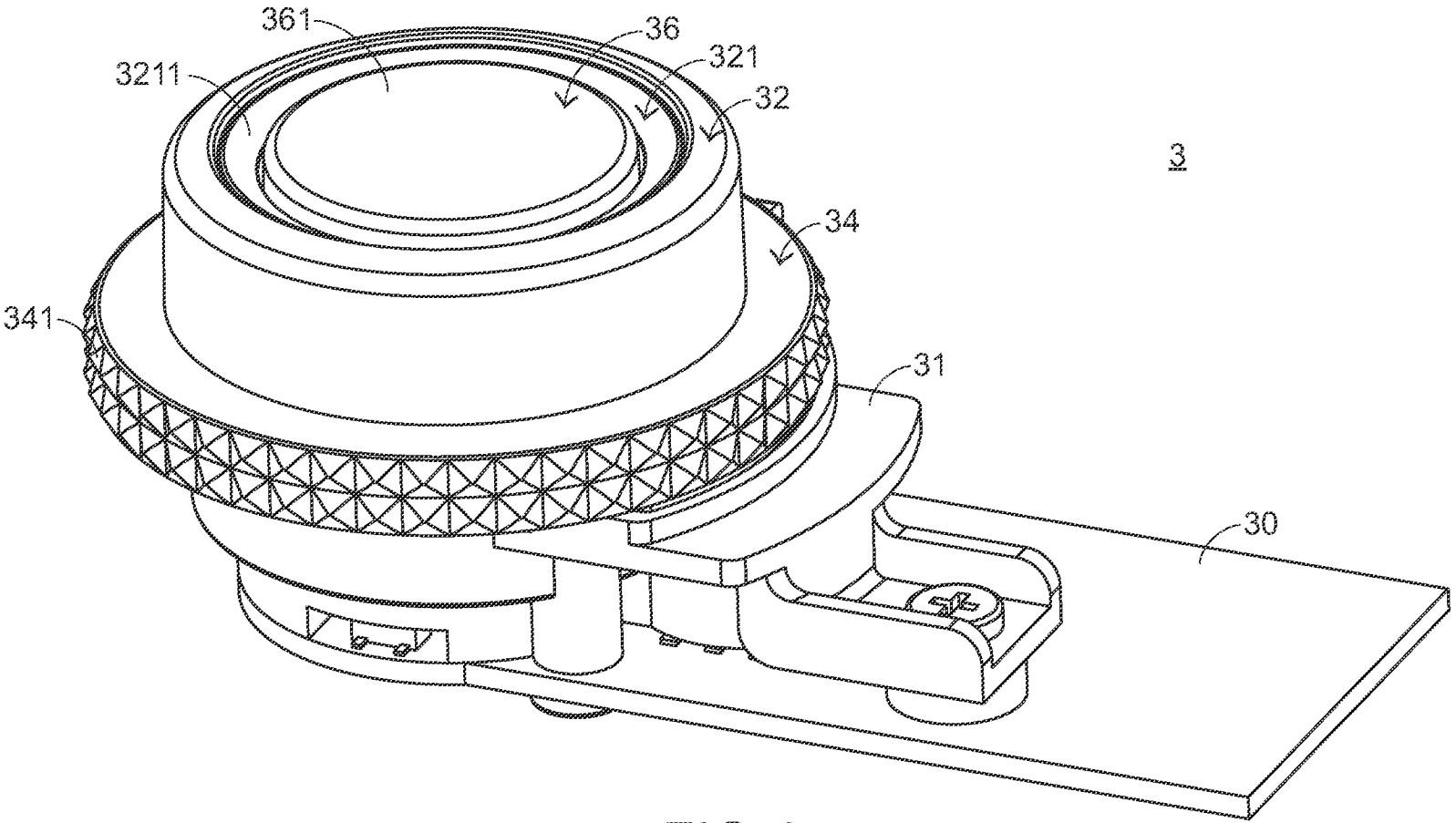
FIG. 4 is a schematic perspective view illustrating the outward appearance of a rotary switch mechanism according to an embodiment of the present invention.

FIG. 4 is a schematic perspective view illustrating the outward appearance of a rotary switch mechanism according to an embodiment of the present invention. As shown in FIG. 4, the rotary switch mechanism 3 comprises a main circuit board 30, a base 31, a first rotatable member 32, a second rotatable member 34 and a push button 36. The base 31 is disposed on the main circuit board 30. The first rotatable member 32 is disposed on the base 31. The second rotatable member 34 is disposed on the base 31 and arranged around the first rotatable member 32. In addition, the second rotatable member 34 is rotatable with respect to the base 31. The push button 36 is disposed within the first rotatable member 32. In addition, the push button 36 has a pushing surface 361. The user's finger is movable on the pushing surface 361 of the push button 36. In the rotary switch mechanism 3, the outer surface of the first rotatable member 32 is a smooth surface. In addition, the outer surface of the second rotatable member 34 has plural pyramidal structures 341. In a case that the user's fingers is contacted with the first rotatable member 32 and the second rotatable member 34, these two rotatable members 32 and 34 can be obviously recognized by the user's fingers through the pyramidal structures 341. Under this circumstance, the possibility of erroneously touching the two rotatable members 32 and 34 will be reduced.

Figure 5:
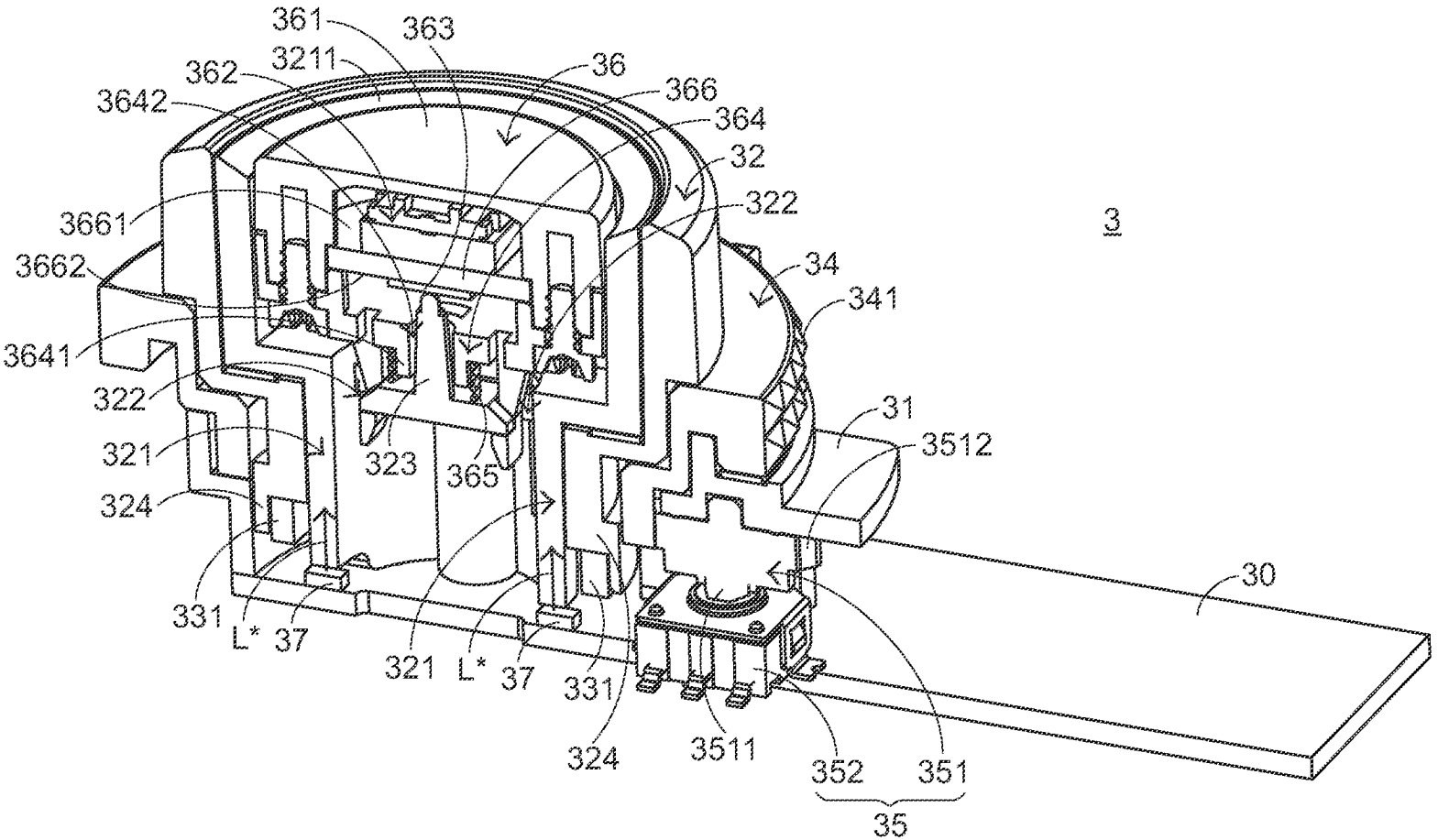
FIG. 5 is a schematic cutaway view illustrating a rotary switch mechanism according to an embodiment of the present invention.
Figure 6:
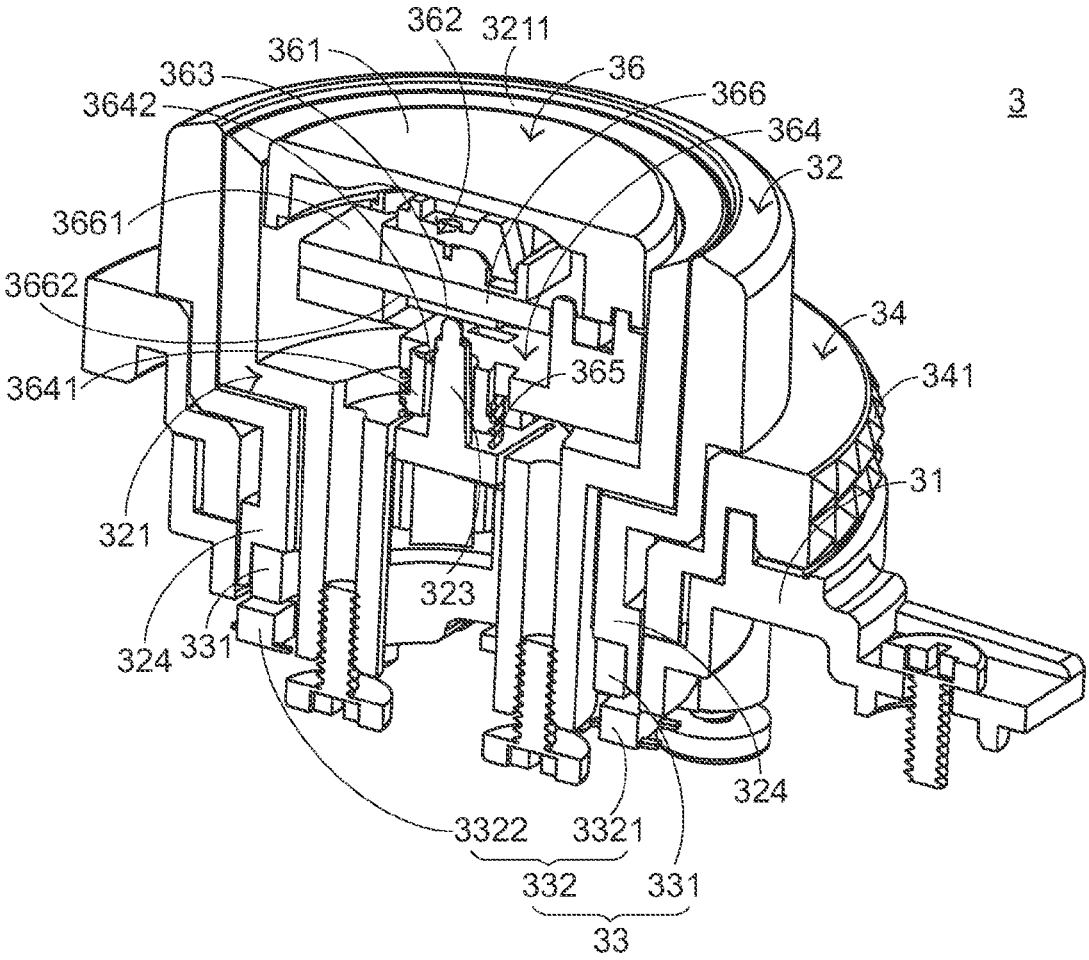
FIG. 6 is a schematic cutaway view illustrating the rotary switch mechanism of FIG. 5 and taken along another viewpoint.

Hereinafter, the internal portion of the rotary switch mechanism 3 of the present invention will be illustrated in more details with reference to FIGS. 5 and 6. FIG. 5 is a schematic cutaway view illustrating a rotary switch mechanism according to an embodiment of the present invention. FIG. 6 is a schematic cutaway view illustrating the rotary switch mechanism of FIG. 5 and taken along another viewpoint. The push button 36 comprises an optical finger navigation (OFN) module 362, a push switch 363, a push button holder 364, an elastic element 365 and a push button circuit board 366. The optical finger navigation module 362 is disposed within the push button 36 and arranged under the pushing surface 361 for detecting a motion of a user's finger F (see FIG. 7) on the pushing surface 361. In response to the motion of the user's finger F, the optical finger navigation module 362 generates a motion signal. The configurations and the operating principles of the optical finger navigation module 362 will be illustrated later. The push button holder 364 is disposed on a light guide structure 321 of the first rotatable member 32. In addition, the push button holder 364 is movable upwardly and downwardly with respect to the first rotatable member 32. The push button holder 364 comprises a central sleeve 3641 and a central hole 3642. The central sleeve 3641 is disposed under the push switch 363. The central hole 3642 is disposed in the center of the central sleeve 3641.

The push button circuit board 366 is disposed on the push button holder 364. In addition, the optical finger navigation module 362 is disposed on a first surface 3661 of the push button circuit board 366. The push switch 363 is disposed on a second surface 3662 of the push button circuit board 366. The elastic element 365 is sheathed around the central sleeve 3641 and sustained against a triggering part 323 of the first rotatable member 32 for providing an elastic force. Due to the elastic force, the push button holder 364 is movable upwardly to have the push button 36 restore to the original non-pressed position. In this embodiment, the elastic element 365 is a helical spring.

The first rotatable member 32 comprises the light guide structure 321, plural perforations 322 and the triggering part 323. The light guide structure 321 is disposed within the first rotatable member 32. In addition, a top portion 3211 of the light guide structure 321 is exposed outside the first rotatable member 32 and arranged around the pushing surface 361 of the push button 36. After the push button holder 364 is penetrated through the plural perforations 322, the push button holder 364 is engaged with the light guide structure 321. The triggering part 323 is arranged between the plural perforations 322. In addition, the triggering part 323 is penetrated through the central hole 3642 and arranged in the vicinity of the push switch 363. When the push button 32 is pressed down, the triggering part 323 is sustained against the push switch 363, so that a triggering signal is generated by the push switch 363. In this embodiment, the light guide structure 321 and the triggering part 323 are integrally formed.

Figure 7:
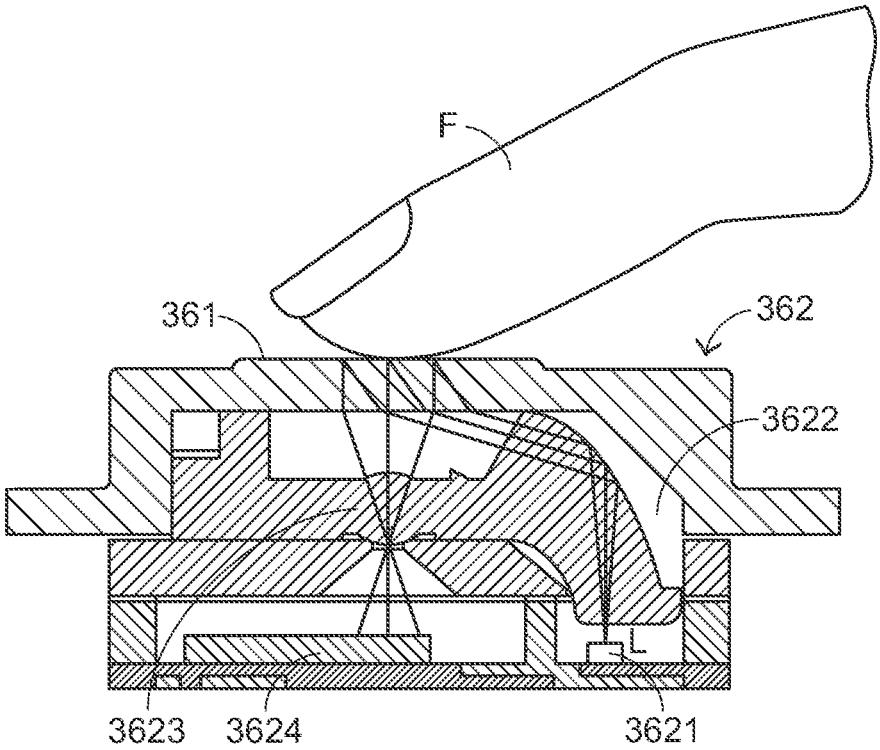
FIG. 7 is a schematic cross-sectional view illustrating an optical finger navigation module of a rotary switch mechanism according to an embodiment of the present invention.

Hereinafter, the internal configurations and the operating principles of the optical finger navigation module 362 will be illustrated with reference to FIG. 7. FIG. 7 is a schematic cross-sectional view illustrating an optical finger navigation module of a rotary switch mechanism according to an embodiment of the present invention. As shown in FIG. 7, the optical finger navigation module 362 comprises a light source 3621, a reflective mirror 3622, a focusing lens 3623 and a motion sensor 3624. The light source 3621 is used for emitting a light beam L. The light beam L is reflected by the reflective mirror 3622 and then projected on the pushing surface 361 of the push button 36. In such way, when the user's finger F is in contact with the pushing surface 361 of the push button 36, the light beam L can be projected on the user's finger F. After the light beam L is reflected by user's finger F, the light beam L is focused by the focusing lens 3623. After the reflected and focused light beam L is received by the motion sensor 3624, the motion sensor 3624 generates a motion signal.

Figure 8:
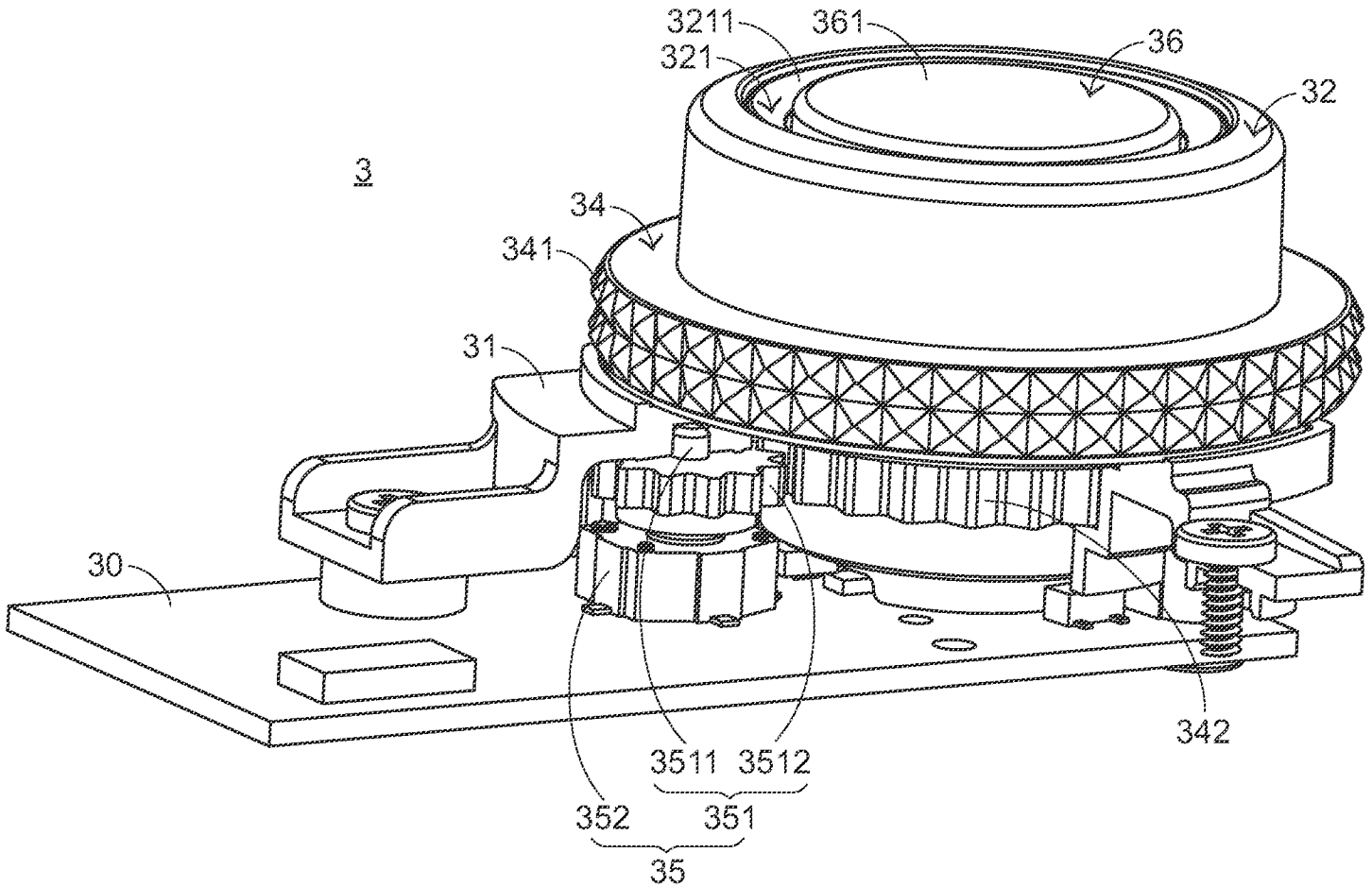
FIG. 8 is a schematic perspective view illustrating the outward appearance of the rotary switch mechanism of FIG. 4 and taken along another viewpoint.

Please refer to FIGS. 5 and 6 again. In addition to the main circuit board 30, the base 31, the first rotatable member 32, the second rotatable member 34 and the push button 36, the rotary switch mechanism 3 further comprises a first signal-generating module 33, a second signal-generating module 35 and plural light emitting diodes 37. The plural light emitting diodes 37 are mounted on the main circuit board 30 for emitting plural light beams L*. After the plural light beams L* are directed to the light guide structure 321, the light beams L* are guided by the light guide structure 321 and projected onto the region between the push button 36 and the first rotatable member 32, thereby illuminating the first rotatable member 32. The second signal-generating module 35 is mounted on the main circuit board 30. In response to rotation of the second rotatable member 34, the second signal-generating module 35 generates a second rotation signal. In this embodiment, the second signal-generating module 35 comprises an idle wheel 351 and an encoder 352. The idle wheel 351 is disposed on the base 31. In addition, the idle wheel 351 comprises a rotating shaft 3511 and plural idle wheel saw-toothed parts 3512. The rotating shaft 3511 is extended from a middle portion of the idle wheel 351. The plural idle wheel saw-toothed parts 3512 are arranged around the idle wheel 351. In addition, the plural idle wheel saw-toothed parts 3512 are engaged with corresponding rotatable member saw-toothed parts 342 of the second rotatable member 34 (see FIG. 8), so that the idle wheel 351 is synchronously rotated with the second rotatable member 34. The encoder 352 is mounted on the main circuit board 30. In addition, the rotating shaft 3511 of the idle wheel 351 is inserted into the internal portion of the encoder 352. In response to rotation of the idle wheel 351, the second rotation signal is generated by the encoder 352.

The first signal-generating module 33 is mounted on the main circuit board 30. In response to rotation of the first rotatable member 32, the first signal-generating module 33 generates a first rotation signal. The first signal-generating module 33 comprises a magnetic ring 331 and a reed sensor assembly 332. The magnetic ring 331 is disposed on a lower portion 324 of the first rotatable member 32, so that the magnetic ring 331 is synchronously rotated with the first rotatable member 32. The reed sensor assembly 332 is mounted on the main circuit board 30, and arranged in the vicinity of the magnetic ring 331. By detecting the rotation of the magnetic ring 331, the reed sensor assembly 332 generates the first rotation signal.

Figure 9:
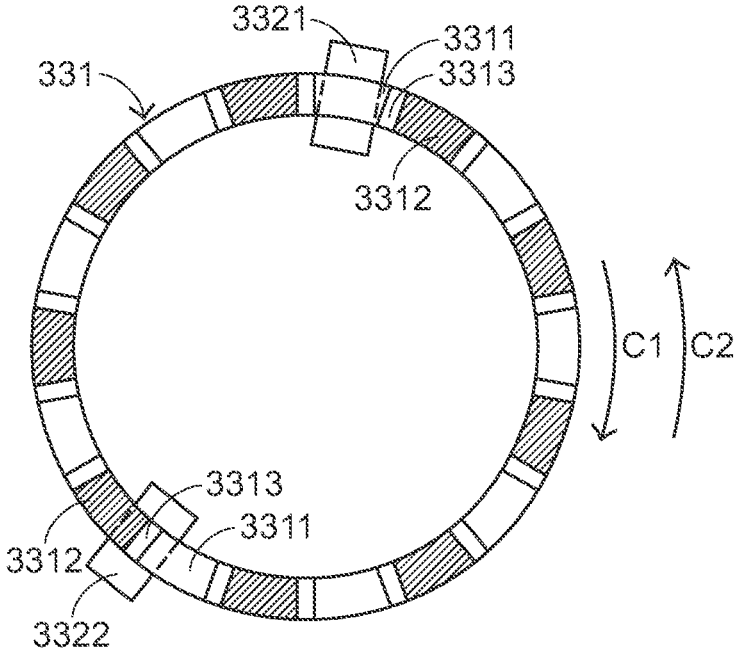
FIG. 9 is a schematic top view illustrating a magnetic ring and a reed sensor assembly of a rotary switch mechanism according to an embodiment of the present invention.

Hereinafter, the configurations of the first signal-generating module 33 will be illustrated in more details with reference to FIG. 9. FIG. 9 is a schematic top view illustrating the magnetic ring and the reed sensor assembly of the rotary switch mechanism according to an embodiment of the present invention. After a magnetizing operation is performed on the magnetic ring 331, the magnetic ring 331 comprises plural N-pole regions 3311, plural S-pole regions 3312 and plural spacer regions 3313. One side of each spacer region 3313 is adjacent to an N-pole region 3311. The other side of each spacer region 3313 is adjacent to an S-pole region 3312. The reed sensor assembly 332 comprises a first reed sensor 3321 and a second reed sensor 3322. In this embodiment, the first reed sensor 3321 is disposed under the N-pole region 3311 to detect the magnetic field change between the N-pole region 3311 and the S-pole region 3312. The second reed sensor 3322 is disposed under the spacer region 3313 to detect the magnetic field change between the N-pole region 3311 and the S-pole region 3312. That is, in response to the magnetic field change detected by the first reed sensor 3321 and the second reed sensor 3322, the first rotation signal is generated.

In a case that the magnetic ring 331 is rotated in a first rotation direction C1 (e.g. the clockwise direction), the magnetic field change from an N-pole region 3311 to an S-pole region 3312 is detected by the first reed sensor 3321. When the rotation of the magnetic ring 331 is stopped, another S-pole region 3312 is disposed over the first reed sensor 3321. At the same time, the magnetic field change from a non-magnetic spacer region 3313 to an N-pole region 3311 is detected by the second reed sensor 3322. When the rotation of the magnetic ring 331 is stopped, another spacer region 3313 is disposed over the second reed sensor 3322. In a case that the magnetic ring 331 is rotated in a second rotation direction C2 (e.g. the anti-clockwise direction), the magnetic field change from an N-pole region 3311 to an S-pole region 3312 is detected by the first reed sensor 3321. When the rotation of the magnetic ring 331 is stopped, another S-pole region 3312 is disposed over the first reed sensor 3321. At the same time, the magnetic field change from a non-magnetic spacer region 3313 to an N-pole region 3311 is detected by the second reed sensor 3322. When the rotation of the magnetic ring 331 is stopped, another spacer region 3313 is disposed over the second reed sensor 3322. That is, by simulating the operations of the encoder, the reed sensor assembly 332 can judge the operating situation of the magnetic ring 331 and generate the first rotation signal.

Hereinafter, the operations of the rotary switch mechanism 3 will be illustrated with reference to FIGS. 5 and 6. When the push button 36 of the rotary switch mechanism 3 is pressed down, in response to the downward force, the push button holder 364 is moved downwardly to compress the elastic element 365. As the push button holder 364 is moved downwardly, the push switch 363 on the push button holder 364 and the triggering part 323 that is penetrated through the central hole 3642 will be contacted with each other. Under this circumstance, the push switch 363 is triggered to generate a pushing signal. According to the pushing signal, the computer system (not shown) connected with the rotary switch mechanism 3 will execute a pushing command. Whereas, when the push button 36 is no longer pressed down and the downward force exerted on the push button 36 is eliminated, the compressed elastic element 365 is restored to generate an elastic force. Due to the elastic force exerted on the push button holder 364, the push button holder 364 is returned to the original non-pressed position.

Please refer to FIGS. 4 and 8 again. When the user's finger F is moved on the optical finger navigation module 362 of the push button 36, the light beam L emitted by light source 3621 of the optical finger navigation module 362 is projected on the pushing surface 361 of the push button 36 and reflected by the user's finger F. Then, the light beam L is focused by the focusing lens 3623 and received by the motion sensor 3624, so that a motion signal is generated by the motion sensor 3624. According to the motion signal, the computer system (not shown) connected with the rotary switch mechanism 3 will execute a moving command. By executing the moving command, the cursor shown on the computer system is correspondingly moved. Under this circumstance, the rotary switch mechanism 3 has a function similar to a mouse device.

Please refer to FIGS. 5 and 6 again. In a case that the first rotatable member 32 of the rotary switch mechanism 3 is rotated, the magnetic ring 331 is synchronously rotated with the first rotatable member 32. In addition, by detecting the magnetic field change according to the rotation of the magnetic ring 331, the reed sensor assembly 332 generates the first rotation signal. According to the first rotation signal, the computer system (not shown) connected with the rotary switch mechanism 3 will execute a first rotation command.

In a case that the second rotatable member 34 of the rotary switch mechanism 3 is rotated, since the rotatable member saw-toothed parts 342 of the second rotatable member 34 are engaged with the plural idle wheel saw-toothed parts 3512 of the idle wheel 351, the idle wheel 351 is driven to rotate by the second rotatable member 34. Moreover, since the rotating shaft 3511 of the idle wheel 351 is inserted into the encoder 352, in response to rotation of the idle wheel 351, the encoder 352 generates the second rotation signal. According to the second rotation signal, the computer system (not shown) connected with the rotary switch mechanism 3 will execute a second rotation command.

From the above description, the rotary switch mechanism of the present invention comprises a first rotatable member and a second rotatable member. In addition, the second rotatable member is arranged around the first rotatable member, so that the first rotatable member and the second rotatable member are collectively defined as a two-layered rotary switch structure. In other words, the rotary switch mechanism of the present invention can be used to execute two rotation commands, thereby performing two rotary switch functions. In addition, the first rotatable member of the rotary switch mechanism comprises an optical finger navigation module and a push switch. By means of the optical finger navigation module and the push switch, the cursor-moving command and the clicking and selecting command are executed. In other words, by the first rotatable member, the second rotatable member, the optical finger navigation module and the push switch, the rotary switch mechanism of the present invention can be used to execute four commands. Since the configurations and functions of these four components are independent of each other, any two of these components may be operated to execute another different command. For example, the sound volume adjustment command (i.e. the first rotation command) is executed by rotating the first rotatable member; the text file proportional scale command (i.e. the second rotation command) is executed by rotating the second rotatable member; the cursor-moving command (i.e. the motion command) is executed by moving the user's finger on the optical finger navigation module; and the clicking and selecting command is executed by pressing the push switch. Whereas, by simultaneously rotating the first rotatable member and moving the user's finger on the optical finger navigation module, the original sound volume adjustment command and the original cursor-moving command are not executed, but the image file proportional scale command (i.e. another command) is executed. From the above description, any two of the four components (i.e. the first rotatable member, the second rotatable member, the optical finger navigation module and the push switch) may be operated to execute an additional command. In other words, the rotary switch mechanism of the present invention may be used for executing more commands when compared with the prior art.

Moreover, since the configurations and functions of the four components are independent of each other, the rotary switch mechanism of the present invention is easily operated and the possibility of causing erroneous operation is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotary switch mechanism, comprising:

a main circuit board;

a base disposed on said main circuit board;

a first rotatable member disposed on said base and rotatable with respect to said base;

a first signal-generating module mounted on said main circuit board, wherein in response to rotation of said first rotatable member, said first signal-generating module generates a first rotation signal;

a second rotatable member disposed on said base, arranged around said first rotatable member, and rotatable with respect to said base;

a second signal-generating module mounted on said main circuit board, wherein in response to rotation of said second rotatable member, said second signal-generating module generates a second rotation signal; and a push button disposed within said first rotatable member, and comprising a pushing surface, wherein said push button comprises:

an optical finger navigation module disposed within said push button and arranged under said pushing surface of said push button for detecting a motion of a user's finger on said pushing surface, wherein in response to said motion of said user's finger, said optical finger navigation module generates a motion signal; and a push switch disposed under said optical finger navigation module, wherein when said push button is pressed down, said push switch is triggered to generate a triggering signal.

2. The rotary switch mechanism according to claim 1 wherein said first signal-generating module comprises:

a magnetic ring disposed on a lower portion of said first rotatable member, and synchronously rotated with said first rotatable member; and a reed sensor assembly mounted on said main circuit board and arranged in the vicinity of said magnetic ring for detecting rotation of said magnetic ring, thereby generating said first rotation signal.

3. The rotary switch mechanism according to claim 2 wherein said magnetic ring comprises plural N-pole regions, plural S-pole regions and plural spacer regions, wherein one side of each spacer region is adjacent to an N-pole region, and the other side of each spacer region is adjacent to an S-pole region.

4. The rotary switch mechanism according to claim 3 wherein said reed sensor assembly comprises:

a first reed sensor disposed under said N-pole region or said S-pole region to detect a magnetic field change between said N-pole region and said S-pole region; and a second reed sensor disposed under said spacer region to detect a magnetic field change between said N-pole region and said S-pole region.

5. The rotary switch mechanism according to claim 1 wherein said second signal-generating module comprises:

an idle wheel disposed on said base, and comprising a rotating shaft and plural idle wheel saw-toothed parts, wherein said plural idle wheel saw-toothed parts are engaged with plural rotatable member saw-toothed parts of said second rotatable member, so that said idle wheel is synchronously rotated with said second rotatable member; and an encoder mounted on said main circuit board, wherein said rotating shaft of said idle wheel is inserted into said encoder, wherein in response to rotation of said idle wheel, said second rotation signal is generated by said encoder.

6. The rotary switch mechanism according to claim 1 wherein said push button further comprises:

a push button holder disposed on said first rotatable member and movable upwardly and downwardly with respect to said first rotatable member, wherein said push button holder comprises a central sleeve and a central hole, said central sleeve is disposed under said push switch, and said central hole is disposed in a center of said central sleeve;

an elastic element sheathed around said central sleeve and sustained against said first rotatable member for providing an elastic force, wherein in response to said elastic force, said push button holder is movable upwardly; and a push button circuit board disposed on said push button holder, wherein said optical finger navigation module is disposed on a first surface of said push button circuit board, and said push switch is disposed on a second surface of said push button circuit board.

7. The rotary switch mechanism according to claim 6 wherein said first rotatable member further comprises:

a light guide structure disposed within said first rotatable member, wherein a top portion of said light guide structure is exposed outside said first rotatable member and arranged around said pushing surface of said push button;

plural perforations, wherein after said push button holder is penetrated through said plural perforations, said push button holder is engaged with said light guide structure; and a triggering part arranged between said plural perforations, penetrated through said central hole and arranged in the vicinity of said push switch, wherein when said push button is pressed down to push against said push switch, said triggering signal is generated by said push switch.

8. The rotary switch mechanism according to claim 7 further comprising plural light emitting diodes, which are mounted on said main circuit board for emitting plural light beams, wherein after said plural light beams are directed to said light guide structure, said light beams are guided by said light guide structure and projected onto a region between said push button and said first rotatable member.

9. The rotary switch mechanism according to claim 7 wherein said light guide structure and said triggering part are integrally formed.

10. The rotary switch mechanism according to claim 1 wherein said optical finger navigation module comprises:

a light source for emitting a light beam to be projected on said pushing surface of said push button;

a reflective mirror for reflecting said light beam;

a focusing lens for focusing said light beam that is reflected by said user's finger; and a motion sensor for receiving said light beam, and generating said motion signal according to said light beam.

* * * * *